US007845332B2

(12) United States Patent
Wang

(10) Patent No.: US 7,845,332 B2
(45) Date of Patent: Dec. 7, 2010

(54) ROTARY ENGINE WITH VANES ROTATABLE BY COMPRESSED GAS INJECTED THEREON

(76) Inventor: Sern-Bean Wang, 7F, No. 18, Hsin-Kuo Rd. San-Min Dist., Kaohsiung City (TW)

( * ) Notice: Subject to any disclaimer, the term of this patent is extended or adjusted under 35 U.S.C. 154(b) by 554 days.

(21) Appl. No.: 11/934,838

(22) Filed: Nov. 5, 2007

(65) Prior Publication Data

US 2009/0114184 A1 May 7, 2009

(51) Int. Cl.

| | |
|---|---|
| ***F02B 53/00*** | (2006.01) |
| ***F04C 18/00*** | (2006.01) |
| ***F04C 2/00*** | (2006.01) |
| ***F04C 2/44*** | (2006.01) |
| ***F04C 2/34*** | (2006.01) |
| ***F01C 1/44*** | (2006.01) |

(52) U.S. Cl. ..... 123/241; 123/244; 418/248; 418/249

(58) Field of Classification Search ..... 123/241, 123/243, 244, 248; 418/260, 266–268, 244, 418/248–249; *F04C 2/44, 18/44; F02B 53/00, F02B 53/02, 53/08*

See application file for complete search history.

(56) References Cited

U.S. PATENT DOCUMENTS

| | | | | | |
|---|---|---|---|---|---|
| 997,895 | A | * | 7/1911 | Beeson | 418/248 |
| 1,674,449 | A | * | 6/1928 | Riggs | 123/244 |
| 1,883,129 | A | * | 10/1932 | Trimmer | 418/266 |
| 2,500,458 | A | * | 3/1950 | Hinckley | 418/248 |
| 2,762,346 | A | * | 9/1956 | White | 418/248 |
| 2,878,793 | A | * | 3/1959 | Birk | 418/266 |
| 3,306,269 | A | * | 2/1967 | Dimmock, Jr. | 123/227 |
| 3,684,413 | A | * | 8/1972 | Hinckley | 418/249 |
| 3,759,640 | A | * | 9/1973 | Hinckley et al. | 418/249 |
| 3,771,500 | A | * | 11/1973 | Shakiba | 123/244 |
| 3,801,236 | A | * | 4/1974 | Hinckley | 418/249 |
| 3,912,429 | A | * | 10/1975 | Stevenson | 418/249 |
| 3,924,976 | A | * | 12/1975 | Hinckley | 418/249 |
| 3,978,825 | A | * | 9/1976 | Rogers | 123/244 |
| 3,988,082 | A | * | 10/1976 | Rogers | 418/244 |
| 4,446,829 | A | * | 5/1984 | Yeager | 123/244 |
| 7,143,737 | B2 | * | 12/2006 | Kim | 123/241 |
| 7,578,278 | B2 | * | 8/2009 | Peitzke et al. | 123/241 |

FOREIGN PATENT DOCUMENTS

| | | | | |
|---|---|---|---|---|
| DE | 3226855 | A1 | * | 1/1984 |
| DE | 4119622 | A1 | * | 12/1992 |
| EP | 181972 | A1 | * | 5/1986 |
| JP | 60111077 | A | * | 6/1985 |
| JP | 60187717 | A | * | 9/1985 |
| JP | 61212633 | A | * | 9/1986 |
| JP | 61237833 | A | * | 10/1986 |
| JP | 61241420 | A | * | 10/1986 |

* cited by examiner

*Primary Examiner*—Thai Ba Trieu
(74) *Attorney, Agent, or Firm*—Ladas & Parry LLP

(57) ABSTRACT

A rotary engine includes an outer shell having a plurality of working spaces each receiving a power-generating unit. A rotor is rotatable within the outer shell, and includes a rotor body and a plurality of vanes. When the rotor rotates one revolution in the outer shell, each of the vanes drives each of the power-generating units to complete a working cycle including four strokes of intake, compression, combustion, and exhaust. In each combustion stroke, compressed gas is injected on the corresponding vane to rotate the rotor about the central axis of an output shaft.

2 Claims, 10 Drawing Sheets

ROTARY ENGINE WITH VANES ROTATABLE BY COMPRESSED GAS INJECTED THEREON

BACKGROUND OF THE INVENTION

1. Field of the Invention

This invention relates to an engine, and more particularly to a rotary engine that includes a plurality of vanes, which are rotatable by compressed gas injected thereon.

2. Description of the Related Art

Referring to FIG. 1, a conventional rotary engine 1 includes an outer shell 11, a rotor 12, an output shaft 13, and two spark plugs 14.

The outer shell 11 includes a shell body 111 having an accommodating space 114, and a pair of intake and exhaust ports 112, 113 formed in the shell body 111 and in fluid communication with the accommodating space 114. The rotor 12 is rotatable within the accommodating space 114 in the outer shell 11, and has a generally triangular cross-section. The output shaft 13 extends into the shell body 111 of the outer shell 11 and the rotor 12, and is rotatable relative to the outer shell 11.

When the rotor 12 rotates in the accommodating space 114, three gas chambers 115 are defined between the rotor 12 and the shell body 111. During one revolution of the rotor 12, one working cycle of four strokes including intake, compression, combustion, and exhaust takes place within each of the gas chambers 115. Hence, power is outputted via the output shaft 13.

The aforesaid conventional rotary engine 1 suffers from the following disadvantages:

(1) Only three working cycles are completed respectively within the gas chambers 115 per one revolution of the rotor 12. Hence, the power output of the rotary engine 1 is limited.

(2) Since the rotor 12 rotates about an axis offset from the central axis of the output shaft 13, substantial vibrations occur during rotation of the rotor 12. As a result, running of the engine 1 is unstable.

SUMMARY OF THE INVENTION

The object of this invention is to provide a high-efficiency rotary engine that can run stably.

Accordingly, a rotary engine of this invention includes an outer shell having a plurality of working spaces each receiving a power-generating unit. A rotor is rotatable within the outer shell, and includes a rotor body and a plurality of vanes. When the rotor rotates one revolution in the outer shell, each of the vanes drives each of the power-generating units to complete a working cycle including four strokes of intake, compression, combustion, and exhaust. In each combustion stroke, compressed gas is injected on the corresponding vane to rotate the rotor about the central axis of an output shaft.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 2:
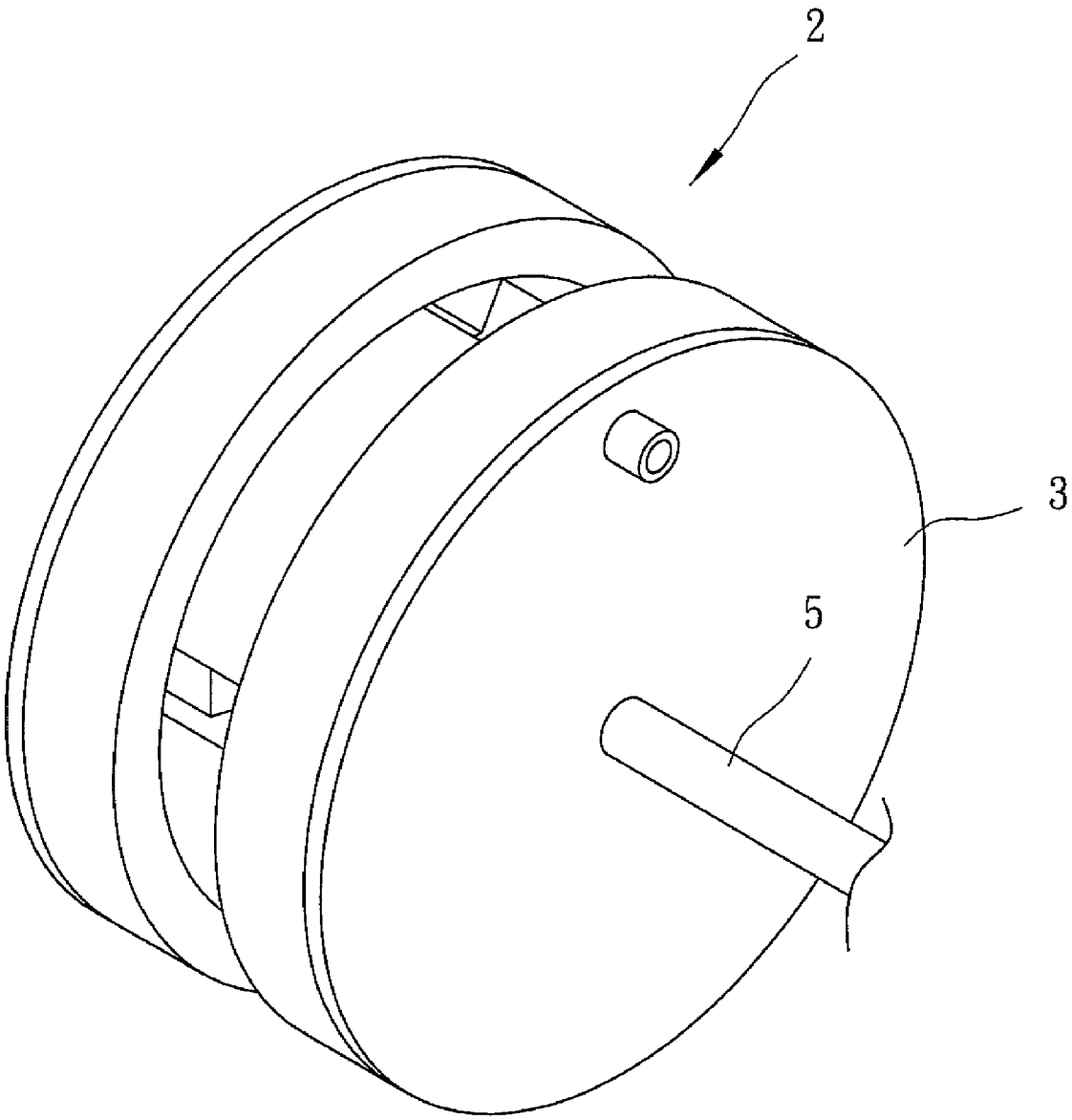
FIG. 2 is an assembled perspective view of the preferred embodiment of a rotary engine according to this invention.
Figure 3:
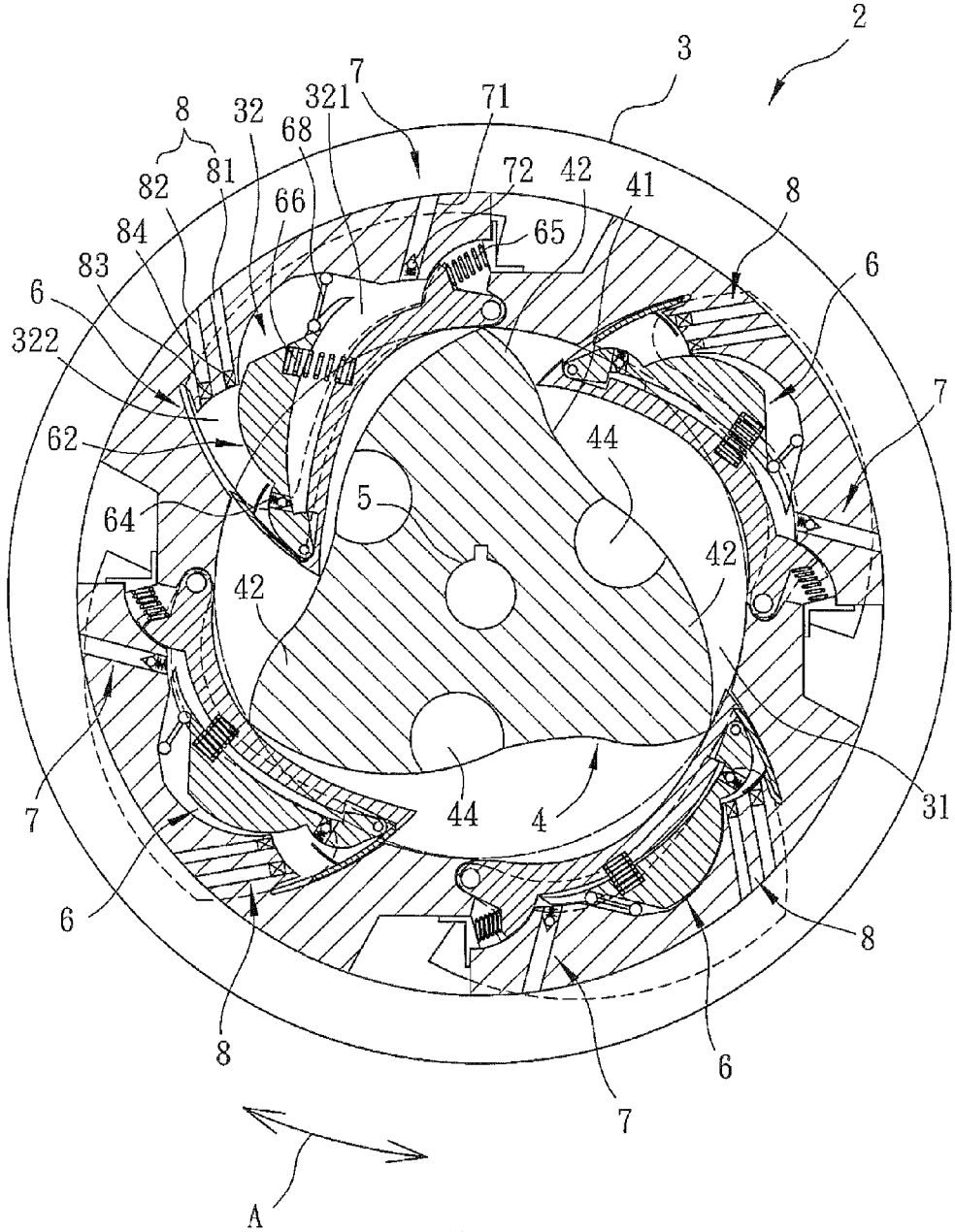
FIG. 3 is a sectional view of the preferred embodiment.

Referring to FIGS. 2 and 3, the preferred embodiment of a rotary engine 2 according to this invention includes an outer shell 3, a rotor 4, a power output shaft 5, four power-generating units 6, four intake units 7, and four ignition units 8.

Figure 4:
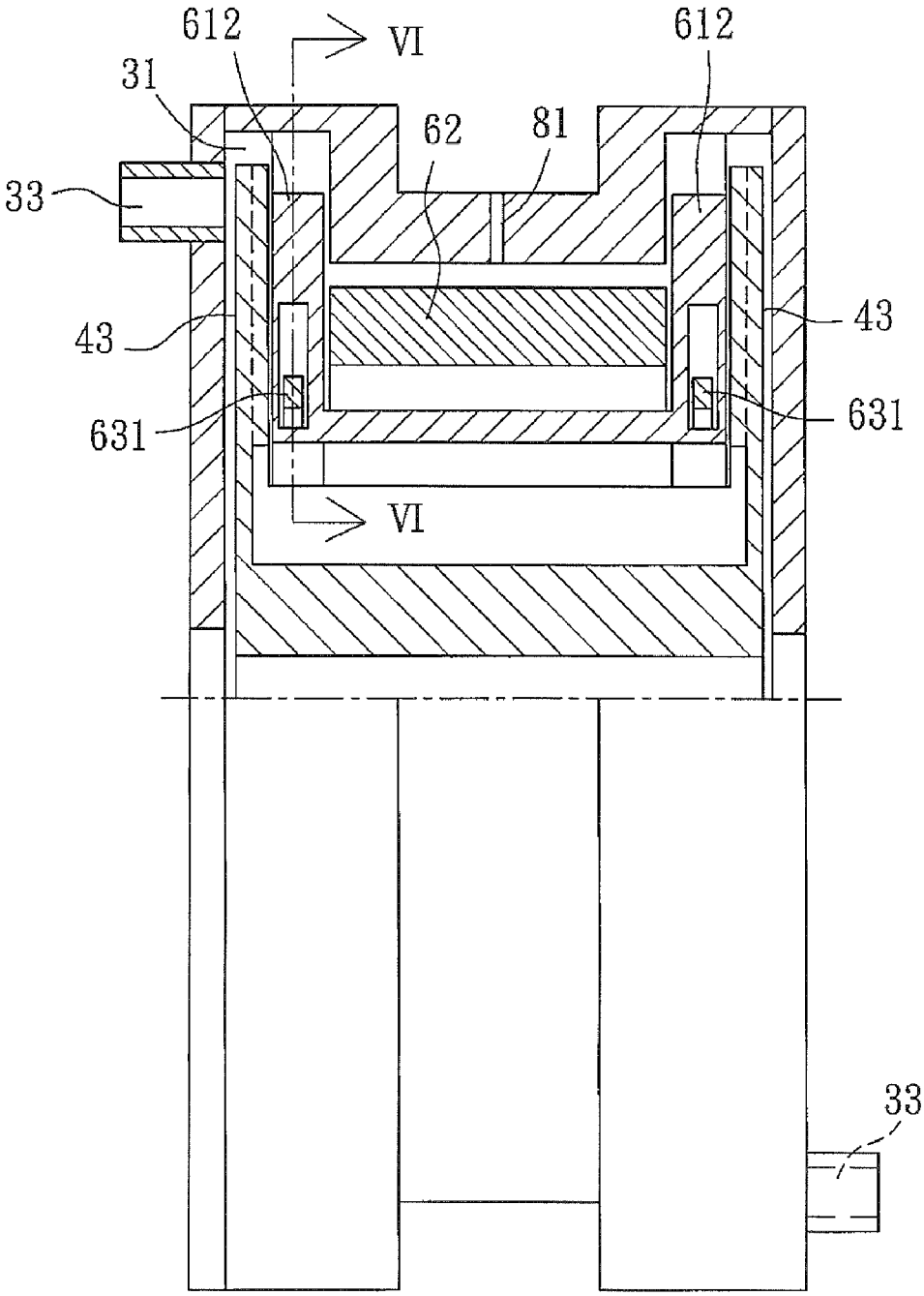
FIG. 4 is a fragmentary sectional view of the preferred embodiment, illustrating a power-generating unit.

With further reference to FIG. 4, the outer shell 3 has an accommodating space 31, two exhaust ports 33 in fluid communication with the accommodating space 31, and four working spaces 32 spaced apart from each other and arranged in a circumferential direction (A) (see FIG. 3) of the outer shell 3. The working spaces 32 are in fluid communication with the accommodating space 31.

Figure 5:
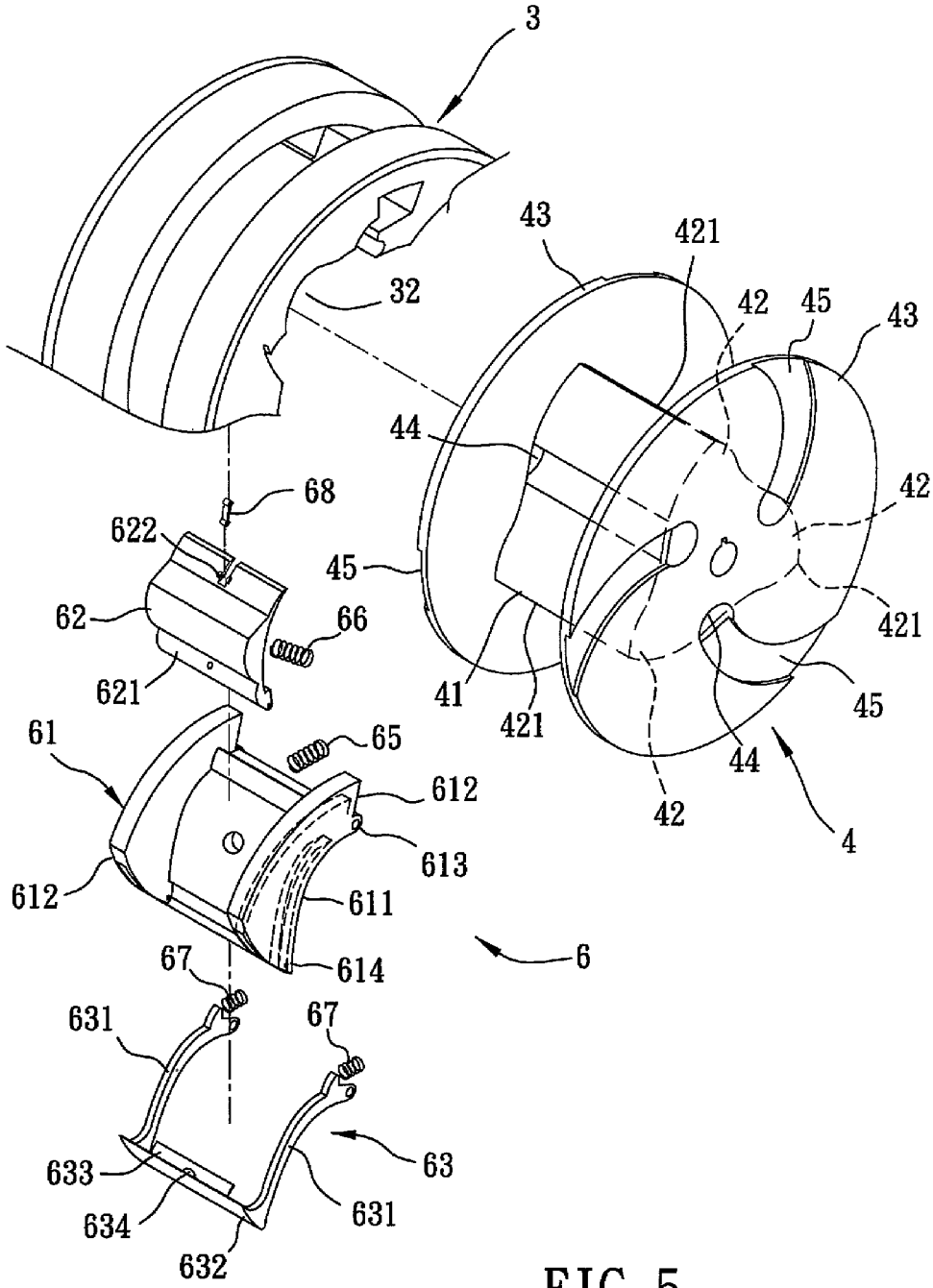
FIG. 5 a fragmentary exploded perspective view of the preferred embodiment.

With further reference to FIG. 5, the rotor 4 is disposed rotatably in the accommodating space 31, and includes a rotor body 41, three vanes 42 extending outwardly from the rotor body 41 and arranged in the circumferential direction (A), two side plates 43 disposed respectively and fixedly on two opposite sides of the rotor body 41 such that the vanes 42 are disposed between the side plates 43, and three first exhaust passages 44 each formed in an outer surface of the rotor body 41 and disposed between two corresponding adjacent ones of the vanes 42. Each of the side plates 43 is formed with three second exhaust passages 45 that are in fluid communication with the first exhaust passages 44, respectively. Each of the vanes 42 has a pushing end 421 distal from the rotor body 41. The power output shaft 5 is rotatable in the outer shell 3, and is connected to and co-rotatable with the rotor body 41 of the rotor 4. The rotor 4 is rotatable about the central axis of the power output shaft 5.

Figure 6:
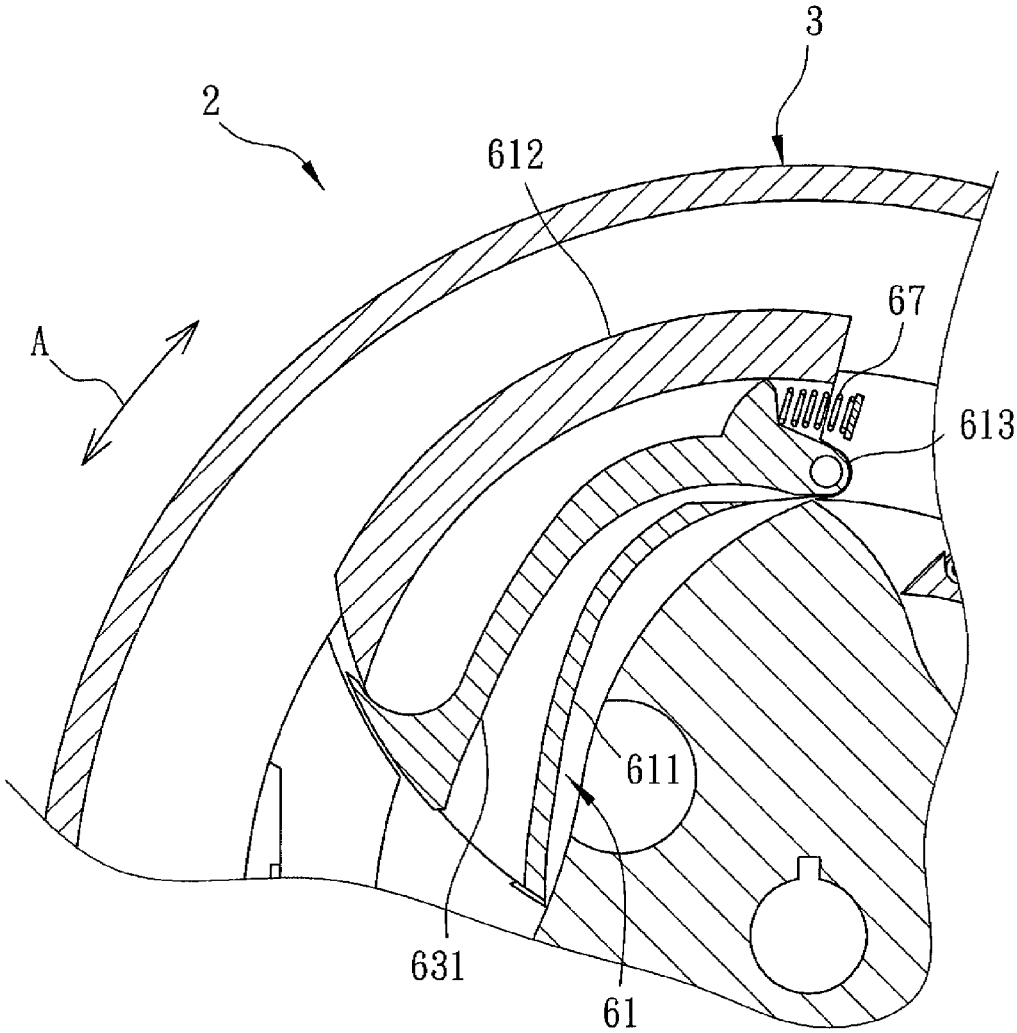
FIG. 6 is a fragmentary sectional view of the preferred embodiment taken along line VI-VI in FIG. 4.
Figure 7:
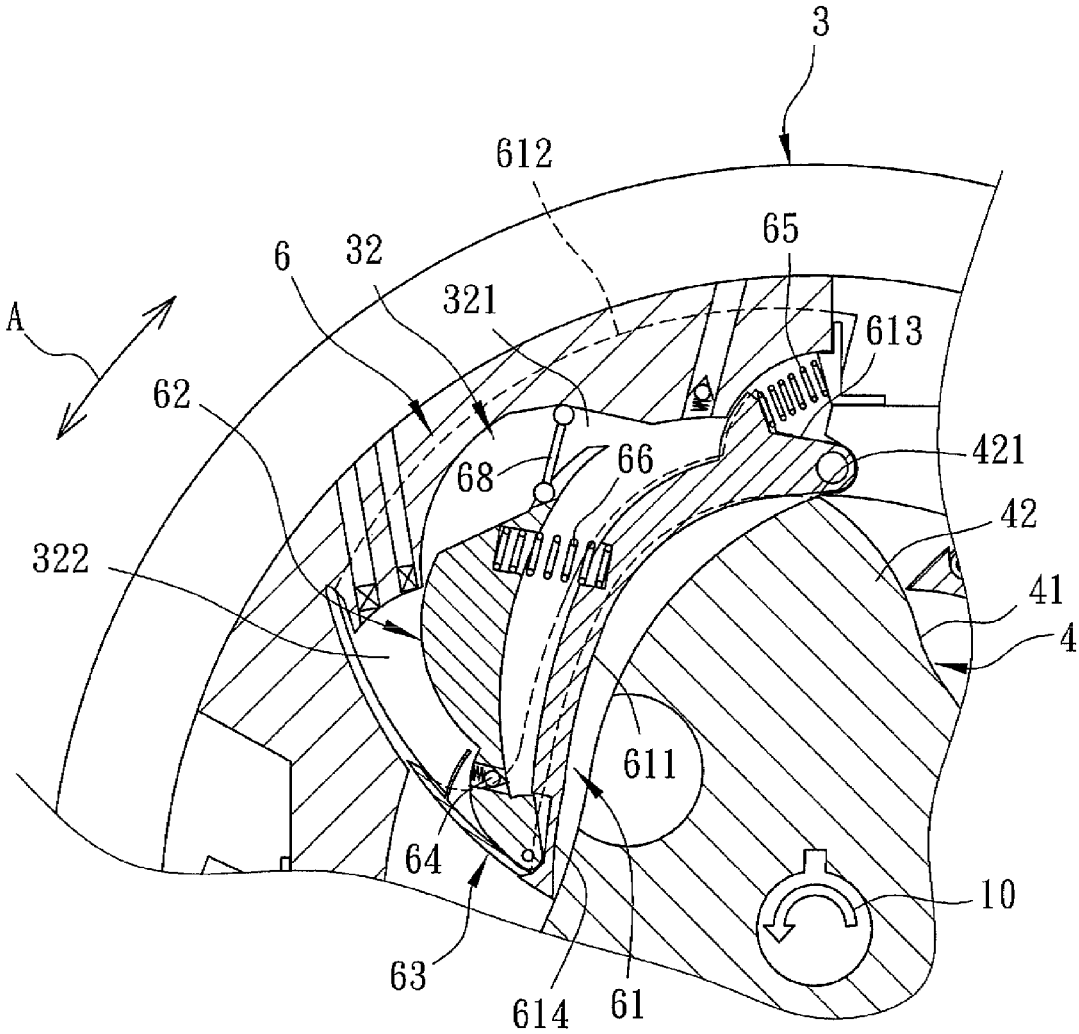
FIG. 7 is a fragmentary sectional view of the preferred embodiment, illustrating how a rotor is rotated counterclockwise.

With further reference to FIGS. 5, 6, and 7, the power-generating units 6 are disposed respectively within the working spaces 32 in the outer shell 3. The structure of one of the power-generating units 6 will be described hereinafter.

The power-generating unit 6 includes a swinging member 61 connected pivotally to the outer shell 3, a divider 62 disposed pivotally on the swinging member 61 for dividing the corresponding working space 32 in the outer shell 3 into an intake chamber 321 and a compression chamber 322, a stop member 63 connected pivotally to the outer shell 3 such that the stop member 63 and the swinging member 61 are rotatable about the same axis, a positioning rod 68 having two opposite ends connected respectively and pivotally to the divider 62 and the outer shell 3, a first one-way valve 64 disposed within the divider 62 for limiting flow of air from the intake chamber 321 into the compression chamber 322, a first resilient member 65 configured as a coiled compression spring and disposed between the swinging member 61 and the outer shell 3 for biasing the swinging member 61 to pivot toward the rotor 4, a second resilient member 66 configured as a coiled compression spring and disposed between the divider 62 and the swinging member 61 for biasing the divider 62 to pivot away from the swinging member 61 and toward the outer shell 3, and two third resilient members 67 configured as coiled compression springs and disposed between the stop member 63 and the outer shell 3 for biasing the stop member 63 toward the rotor 4. The swinging member 61 has a curved wall 611 in contact with the pushing end 421 of the corresponding vane 42 of the rotor 4, and two hollow sidewalls 612 extending respectively from two opposite sides of the curved wall 611 into the corresponding working space 32 in the outer shell 3. The curved wall 611 has a first pivot end 613 connected pivotally to the outer shell 3, and a second pivot end 614 opposite to the first pivot end 613. The divider 62 has a first pivot portion 621 connected pivotally to the second pivot end 614 of the swinging member 61, and a second pivot portion 622 opposite to the first pivot portion 621 and connected pivotally to the positioning rod 68.

The stop member 63 has two link sections 631 disposed respectively within the sidewalls 612 of the swinging member 61 and connected pivotally to the outer shell 3, a stop section 632 interconnecting the link sections 631 and in slidable contact with the sidewalls 612 of the swinging member 61, and an abutment section 633 extending from the stop section 632 toward the first pivot end 613 of the swinging member 61 and having a through hole 634 formed therethrough. Each of the third resilient members 67 has two ends abutting respectively against the outer shell 3 and the corresponding link section 631 of the stop member 63. The corresponding intake chamber 321 is defined among the divider 62, the curved plate 611, and one of the sidewalls 612, while the corresponding compression chamber 322 is defined among the divider 62, the stop member 63, and the other of the sidewalls 612 of the swinging member 61.

With particular reference to FIG. 3, the intake units 7 correspond respectively to the power-generating units 6. Each of the intake units 7 includes an intake port 71 formed in the outer shell 3 and in fluid communication with the corresponding intake chamber 321, and a second one-way valve 72 disposed within the intake port 71 for limiting flow of air from the intake port 71 into the intake chamber 321.

The ignition units 8 also correspond respectively to the power-generating units 6. Each of the ignition units 8 includes a fuel injection hole 81 and a mounting hole 82 that are formed in the outer shell 3 and that are in fluid communication with the corresponding compression chamber 322. Each of the ignition units 8 further includes a spark plug 83 disposed within the mounting hole 82, and a fuel-injecting nozzle 84 disposed within the fuel injection hole 81.

The operation of an assembly of one of the power-generating units 6 and one of the vanes 42 will be described hereinafter.

To enable the operation of the rotary engine 2, a motor (not shown) is actuated to drive rotation of the rotor 4 in a counterclockwise direction shown by the arrow 10 in FIG. 7. Hence, the pushing end 421 of the corresponding vane 42 slides on the curved wall 611 of the swinging member 61. After the rotor 4 rotates for a short period of time, the motor is automatically stopped.

Figure 8:
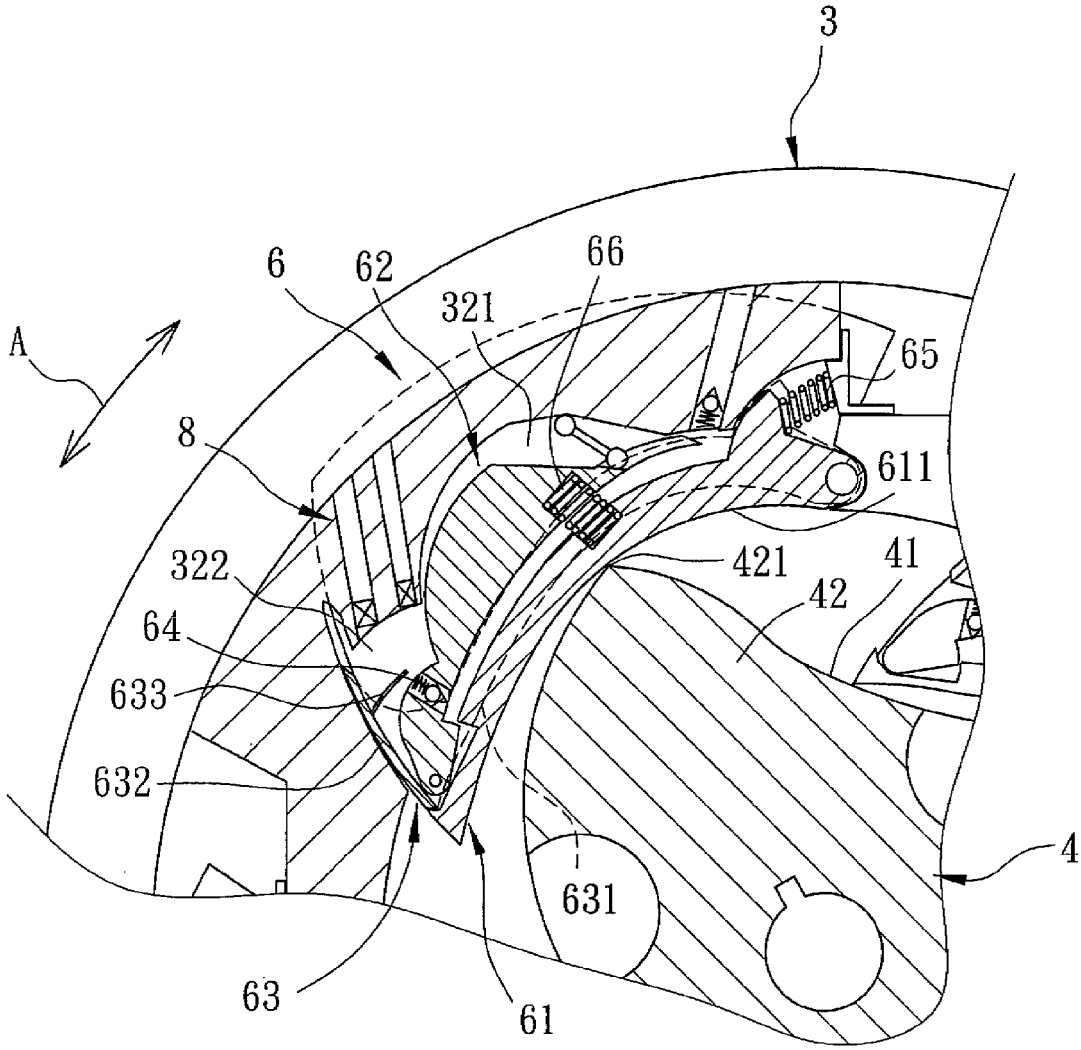
FIG. 8 is a view similar to FIG. 7 but illustrating the power-generating unit in a state at which a compression stroke begins.

With particular reference to FIG. 8, when the pushing end 421 of the vane 42 slides on the curved wall 611, it pushes and pivots the swinging member 61 and the stop member 63 toward the outer shell 3 against the biasing action of the first, second, and third resilient members 65, 66, 67. Hence, the divider 62 is moved along with the swinging member 61 toward the outer shell 3 to reduce the volumes of the intake chamber 321 and the compression chamber 322 to thereby allow flow of air from the intake chamber 321 into the compression chamber 322 via the first one-way valve 64 in the divider 62.

Figure 9:
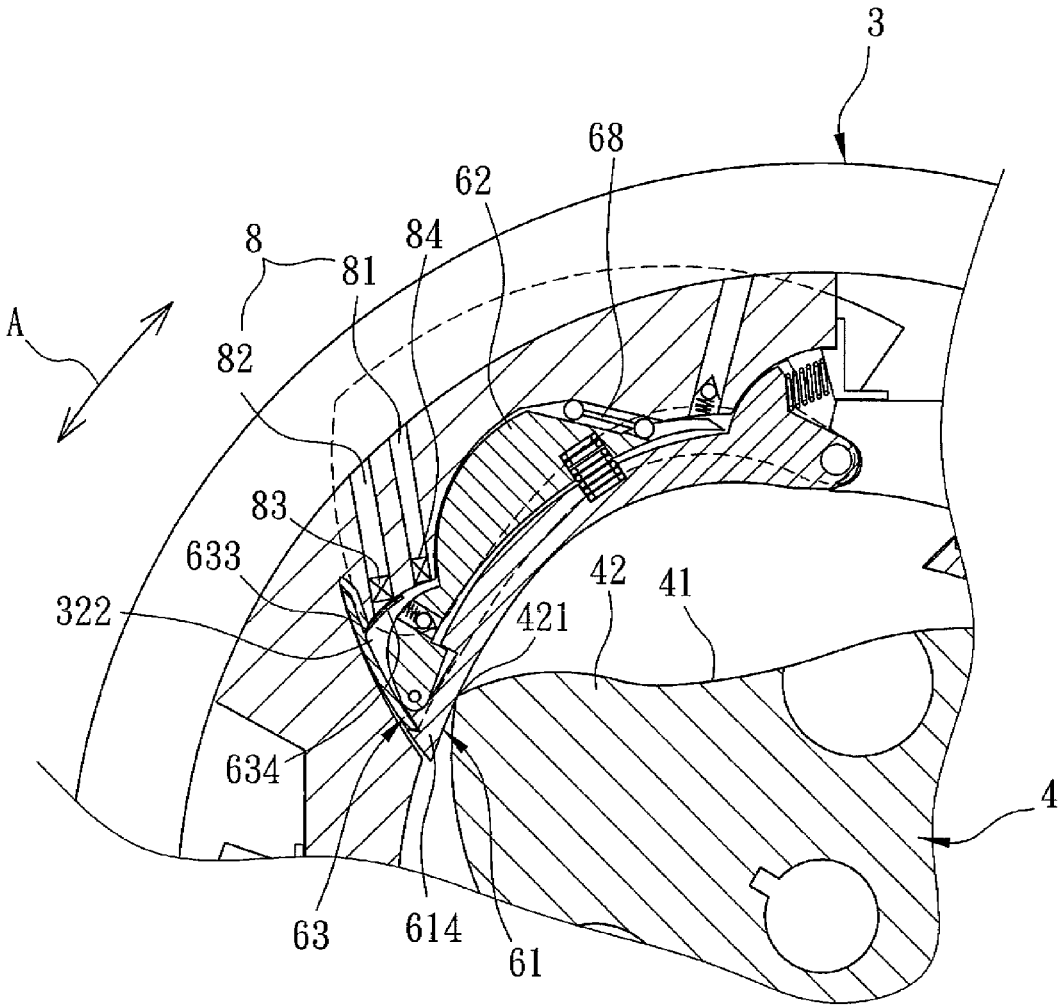
FIG. 9 is a view similar to FIG. 7 but illustrating the power-generating unit in a state at which the compression stroke is finished.

With particular reference to FIG. 9, when the pushing end 421 of the vane 42 moves to a position adjacent to the second pivot end 614 of the swinging member 61, the divider 62, the abutment section 633 of the stop member 63, and the positioning rod 68 come into contact with the outer shell 3. In this state, the through hole 634 in the abutment section 633 is aligned with the spark plug 83, and the compression chamber 322 has a minimum volume. Differently stated, the compression stroke is finished.

At the end of the compression stroke, fuel is injected into the compression chamber 322 by the fuel injection nozzle 84 to mix with the compressed air. Subsequently, the compressed fuel mixture is ignited by the spark plug 83.

Figure 10:
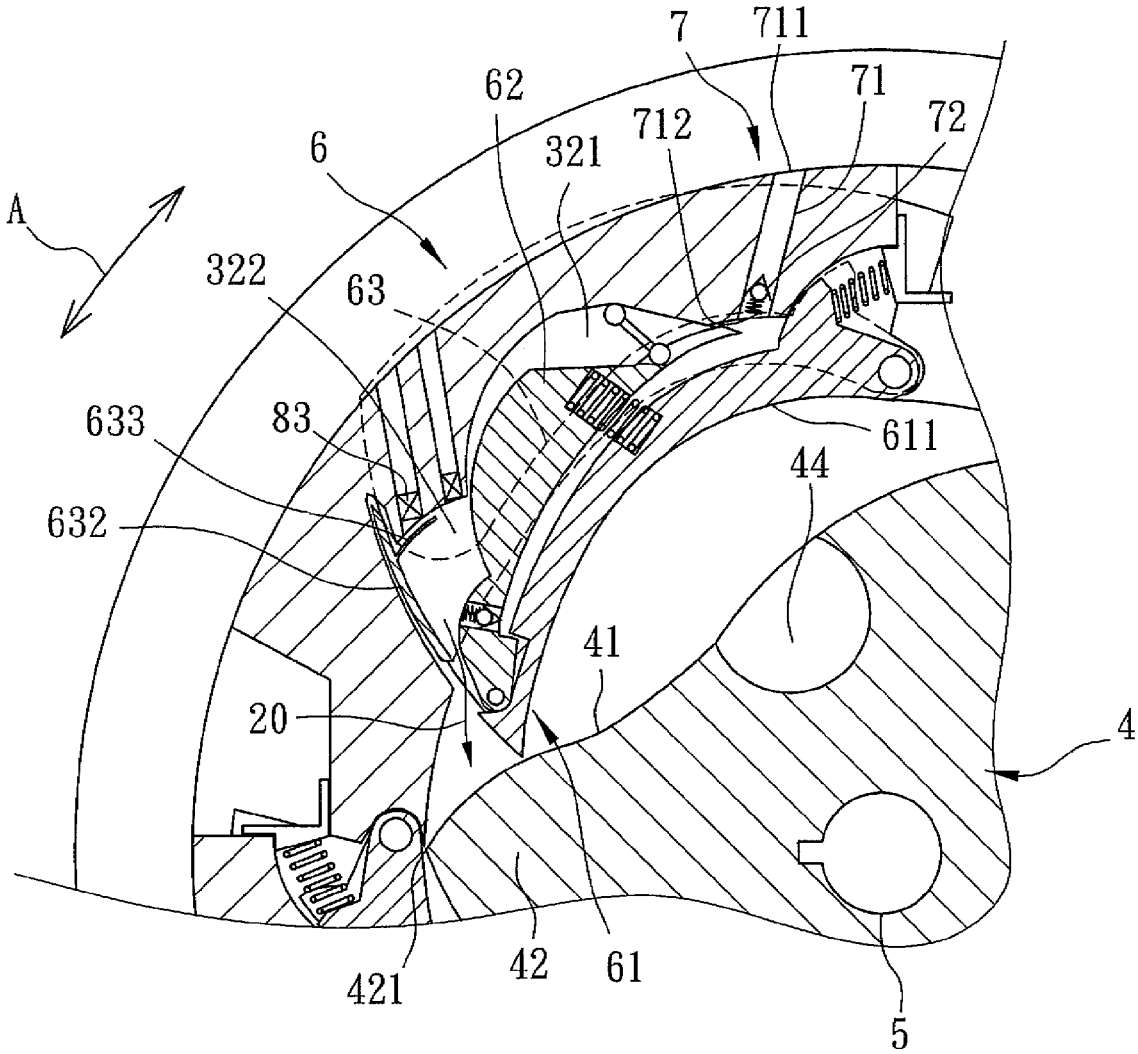
FIG. 10 is a view similar to FIG. 7 but illustrating the power-generating unit in a state at which combustion, exhaust, and intake strokes are carried out at the same time.

With particular reference to FIG. 10, during ignition operation of the spark plug 83, the pushing end 421 of the vane 42 separates from the curved wall 611 of the swinging member 61. Further, because of thrust generated from explosion of the compressed fuel mixture, the swinging member 61 and the divider 62 are urged toward the power output shaft 5, and the abutment section 633 of the stop member 632 is in contact with the outer shell 3. Hence, the volume of the intake chamber 321 is increased to allow air to be drawn from the outside into the intake chamber 321 via the intake port 71 and the second one-way valve 72, and a gap is formed between the stop section 632 of the stop member 63 and the divider 62. As a result of the explosion of the compressed fuel mixture, a compressed gas is created within the compression chamber 322, and is injected onto the vane 42 via the gap in a direction shown by the arrow 20 in FIG. 10 so as to provide a thrust for rotating the rotor body 41 of the rotor 4 and the power output shaft 5. The compressed gas is discharged from the engine 2 through the first and second exhaust passages 44,45.

When the exhaust stroke is finished, due to the restoration forces of the first, second, and third resilient members 65, 66, 67, the swinging member 61, the divider 62, and the stop member 63 are returned to the positions shown in FIG. 7 in preparation for the next working cycle.

Figure 1:
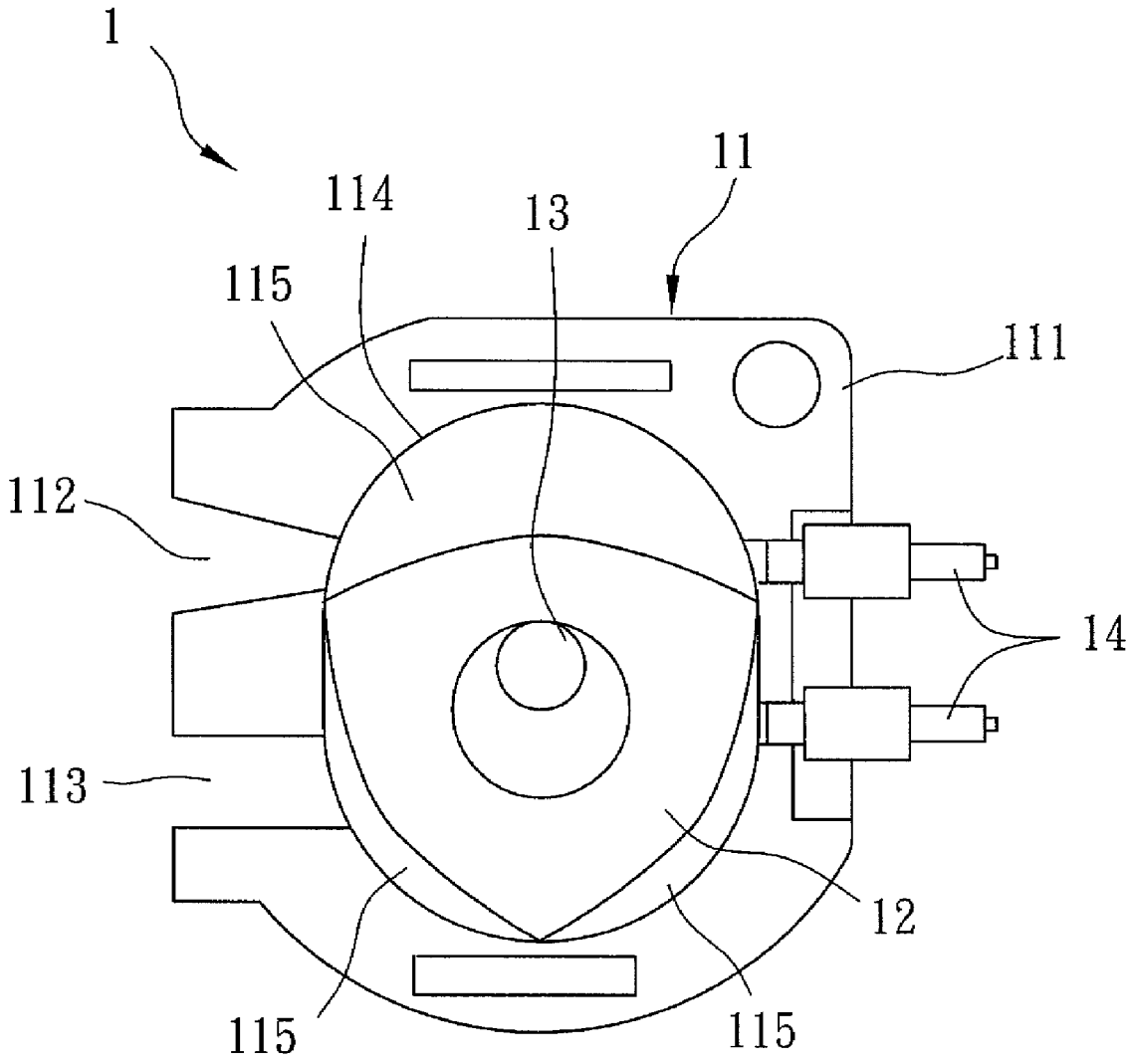
FIG. 1 PRIOR ART
FIG. 1 is a schematic view of a conventional rotary engine.

The rotary engine 2 of this invention has the following advantages:

(1) During one revolution of the rotor 4, each of the three vanes 42 drives each of the power-generating units 6 to complete one working cycle. That is, the rotary engine 2 can perform twelve working cycles per one revolution of the rotor 4 to push an assembly of the rotor 4 and the power output shaft 5 to rotate. When compared to the above-mentioned conventional rotary engine 1 (see FIG. 1), the power output of the rotary engine 2 is increased significantly.

(2) Since the rotor 4 rotates about the central axis of the power output shaft 5, the rotary engine 2 can run stably.

With this invention thus explained, it is apparent that numerous modifications and variations can be made without departing from the scope and spirit of this invention. It is therefore intended that this invention be limited only as indicated by the appended claims.

I claim:

1. A rotary engine comprising:

a) an outer shell comprising:

an accommodating space, at least one exhaust port in fluid communication with said accommodating space, and a plurality of working spaces spaced apart from each other and arranged in a circumferential direction of said outer shell, said working spaces being in fluid communication with said accommodating space;

b) a rotor disposed rotatably in said accommodating space in said outer shell comprising:

a rotor body, a plurality of vanes extending outwardly from said rotor body and arranged in said circumferential direction of said outer shell, wherein each of said vanes includes a pushing end distal from said rotor body, two side plates disposed respectively and fixedly on two opposite sides of said rotor body such that said vanes are disposed between said side plates, a plurality of first exhaust passages each formed in an outer surface of said rotor body and disposed between two corresponding adjacent ones of said vanes, and a plurality of second exhaust passages in fluid communication with said first exhaust passages form in each of said side plates, respectively;

c) a power output shaft rotatable in said outer shell and co-rotatable with said rotor body of said rotor such that said rotor rotates about a central axis of said power output shaft;

d) a plurality of power-generating units disposed respectively within said working spaces in said outer shell, each of said power-generating units comprising:

a swinging member connected pivotally to said outer shell, a divider disposed pivotally on said swinging member for dividing said corresponding one of said working spaces in said outer shell into an intake chamber and a compression chamber, a stop member connected pivotally to said outer shell such that said stop member and said swinging member are rotatable about an axis, a positioning rod having two opposite ends connected respectively and pivotally to said divider and said outer shell, a first one-way valve disposed within said divider for limiting flow of air from said intake chamber into said compression chamber, a first resilient member disposed between said swinging member and said outer shell for biasing said swinging member to pivot toward said rotor, a second resilient member disposed between said divider and said swinging member for biasing said divider to pivot away from said swinging member and toward said outer shell, and a third resilient member disposed between said stop member and said outer shell for biasing said stop member to pivot toward said rotor, wherein each of said swinging members comprises:

a curved wall in contact with said pushing end of a corresponding one of said vanes of said rotor, and two hollow sidewalls extending respectively from two opposite sides of said curved wall into a corresponding one of said working spaces in said outer shell, wherein said curved wall comprises a first pivot end connected pivotally to said outer shell, and a second pivot end opposite to said first pivot end, wherein said divider comprises:

a first pivot portion connected pivotally to said second pivot end of said swinging member, and a second pivot portion opposite to said first pivot portion and connected pivotally to said positioning rod, wherein said stop member comprises:

two link sections disposed respectively within said sidewalls of said swinging member and connected pivotally to said outer shell, a stop section interconnecting said link sections and in slidable contact with said sidewalls of said swinging member, and an abutment section extending from said stop section toward said first pivot end of said swinging member and having a through hole formed therethrough, wherein said intake chamber is defined among said divider, said curved wall, and one of said sidewalls of said swinging member, and wherein said compression chamber is defined among said divider, said stop member, and the other of said sidewalls;

e) a plurality of intake units corresponding respectively to said power-generating units, wherein each of said intake units comprises:

an intake port formed in said outer shell and in fluid communication with a corresponding one of said intake chambers, and a second one-way valve disposed within said intake port for limiting flow of air from said intake port into said intake chamber; and f) a plurality of ignition units corresponding respectively to said power-generating units, wherein each of said ignition units comprises:

a fuel injection hole formed in said outer shell and in fluid communication with a corresponding one of said compression chambers, a mounting hole formed in said outer shell and in fluid communication with said corresponding one of said compression chambers, a fuel-injecting nozzle disposed within said fuel injection hole, and a spark plug disposed within said mounting hole.

2. The rotary engine as claimed in claim 1, wherein said outer shell is formed with a plurality of said exhaust ports.

* * * * *